US010145637B2

(12) United States Patent
Hwang et al.

(10) Patent No.: US 10,145,637 B2
(45) Date of Patent: Dec. 4, 2018

(54) FIREARM BLAST CONTROL SYSTEM

(71) Applicant: Fortis Manufacturing, Inc., Kent, WA (US)

(72) Inventors: Paul Sukho Hwang, Puyallup, WA (US); John J. Hwang, Kent, WA (US); Richard Brady Olsen, Yelm, WA (US)

(73) Assignee: Fortis Manufacturing, Inc., Kent, WA (US)

( * ) Notice: Subject to any disclaimer, the term of this patent is extended or adjusted under 35 U.S.C. 154(b) by 17 days.

(21) Appl. No.: 15/350,641

(22) Filed: Nov. 14, 2016

(65) Prior Publication Data

US 2017/0199002 A1 Jul. 13, 2017

Related U.S. Application Data

(60) Provisional application No. 62/278,001, filed on Jan. 13, 2016.

(51) Int. Cl.

| | |
|---|---|
| ***F41A 21/30*** | (2006.01) |
| ***F41A 21/36*** | (2006.01) |
| ***F41A 21/34*** | (2006.01) |
| ***F41A 21/32*** | (2006.01) |

(52) U.S. Cl.
CPC ..... *F41A 21/36* (2013.01); *F41A 21/325* (2013.01); *F41A 21/34* (2013.01)

(58) Field of Classification Search
CPC ..... F41A 21/30; F41A 21/325; F41A 21/36; F41A 21/34; F41A 35/00
USPC ..... 89/14.2–14.4; 42/90; 181/223
See application file for complete search history.

(56) References Cited

U.S. PATENT DOCUMENTS

| | | | | |
|---|---|---|---|---|
| 4,436,017 | A * | 3/1984 | Mohlin | F41A 21/36 89/14.3 |
| 4,869,151 | A * | 9/1989 | Chahin | F41A 21/30 181/223 |
| 5,631,438 | A * | 5/1997 | Martel | F41A 21/36 42/79 |
| 9,506,710 | B2 * | 11/2016 | Smith | F41A 21/30 |
| 2003/0019352 | A1 * | 1/2003 | Mika | F41A 21/36 89/14.05 |
| 2005/0115394 | A1 * | 6/2005 | Matthews | F41A 21/30 89/14.4 |
| 2005/0188829 | A1 * | 9/2005 | Hanslick | F41A 21/38 89/14.3 |
| 2006/0060076 | A1 * | 3/2006 | Dueck | F41A 21/30 89/14.4 |
| 2008/0084064 | A1 * | 4/2008 | Kerin | B29C 65/0672 285/319 |

(Continued)

*Primary Examiner* — Michael D David
(74) *Attorney, Agent, or Firm* — Eversheds Sutherland (US) LLP

(57) ABSTRACT

A blast control device for a firearm is disclosed. The blast control device may include a muzzle brake comprising a first end, a second end, a top, a bottom, a bore, one or more baffles, one or more gas openings disposed between the one or more baffles, an alignment channel disposed on the top, one or more gas holes disposed on the top within the alignment channel, an alignment groove disposed at an end of the alignment channel, and a latch notch. The blast control device also may include a blast shield attachable around the muzzle brake. The blast shield may include an alignment protrusion, a latch assembly, a plurality of internal ribs, and one or more gas ports.

7 Claims, 5 Drawing Sheets

(56) References Cited

U.S. PATENT DOCUMENTS

| | | | | |
|---|---|---|---|---|
| 2010/0282056 | A1* | 11/2010 | Hung | F41A 21/34 89/14.2 |
| 2011/0297477 | A1* | 12/2011 | Koumbis | F41A 21/30 181/223 |
| 2012/0152093 | A1* | 6/2012 | Koumbis | F41A 21/30 89/14.4 |
| 2012/0180352 | A1* | 7/2012 | Addis | F41A 21/32 42/1.06 |
| 2012/0180624 | A1* | 7/2012 | Troy | F41A 21/30 89/14.4 |
| 2012/0199415 | A1* | 8/2012 | Shults | F41A 21/30 181/223 |
| 2012/0291614 | A1* | 11/2012 | Koumbis | F41A 21/30 89/14.4 |
| 2013/0168181 | A1* | 7/2013 | Wirth | F41A 21/30 181/223 |
| 2014/0231168 | A1* | 8/2014 | Dueck | F41A 21/325 181/223 |
| 2016/0076844 | A1* | 3/2016 | Miller, III | F41A 21/30 89/14.3 |
| 2016/0084602 | A1* | 3/2016 | Smith | F41A 21/325 89/14.4 |
| 2017/0199006 | A1* | 7/2017 | Hwang | F41C 23/16 |

* cited by examiner

FIREARM BLAST CONTROL SYSTEM

CROSS-REFERENCE TO RELATED APPLICATIONS

The disclosure claims priority to and the benefit of U.S. provisional application No. 62/278,001, filed Jan. 13, 2016, which is incorporated by reference herein in its entirety.

FIELD OF THE DISCLOSURE

The disclosure generally relates to firearms and more particularly relates to systems and methods for a blast control device for a firearm.

BACKGROUND

Typical muzzle brakes are designed to reduce the recoil that occurs when a firearm is discharged. The recoil occurs from the burst of gases that follow the departure of the projectile from the firearm. Muzzle brakes may divert a portion of the expanding gases at an angle, which prevents at least some of the force from being translated toward the person firing the firearm. However, the reduction in recoil achieved by a muzzle brake may increase the sound perceived by the user as well as increase gas exposure for nearby bystanders.

SUMMARY

Some or all of the above needs and/or problems may be addressed by certain embodiments of the blast control device for a firearm disclosed herein. According to an embodiment, the blast control device may include a muzzle brake comprising a first end, a second end, a top, a bottom, a bore, one or more baffles, one or more gas openings disposed between the one or more baffles, an alignment channel disposed on the top, one or more gas holes disposed on the top within the alignment channel, an alignment groove disposed at an end of the alignment channel, and a latch notch. The blast control device also may include a blast shield attachable around the muzzle brake. The blast shield may include an alignment protrusion, a latch assembly, a plurality of internal ribs, and one or more gas ports.

Other features and aspects of the blast control device will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 2:
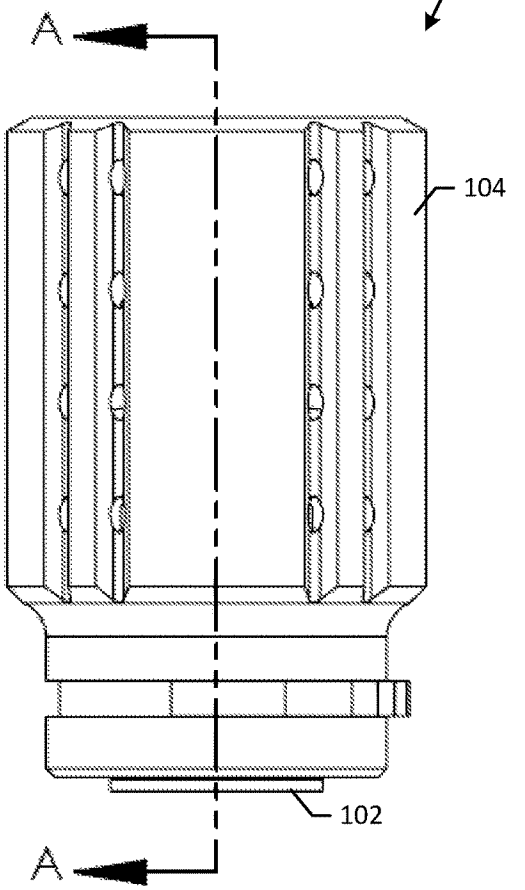
FIG. 2 depicts a side view of a blast control device in accordance with one or more embodiments of the disclosure.
Figure 1:
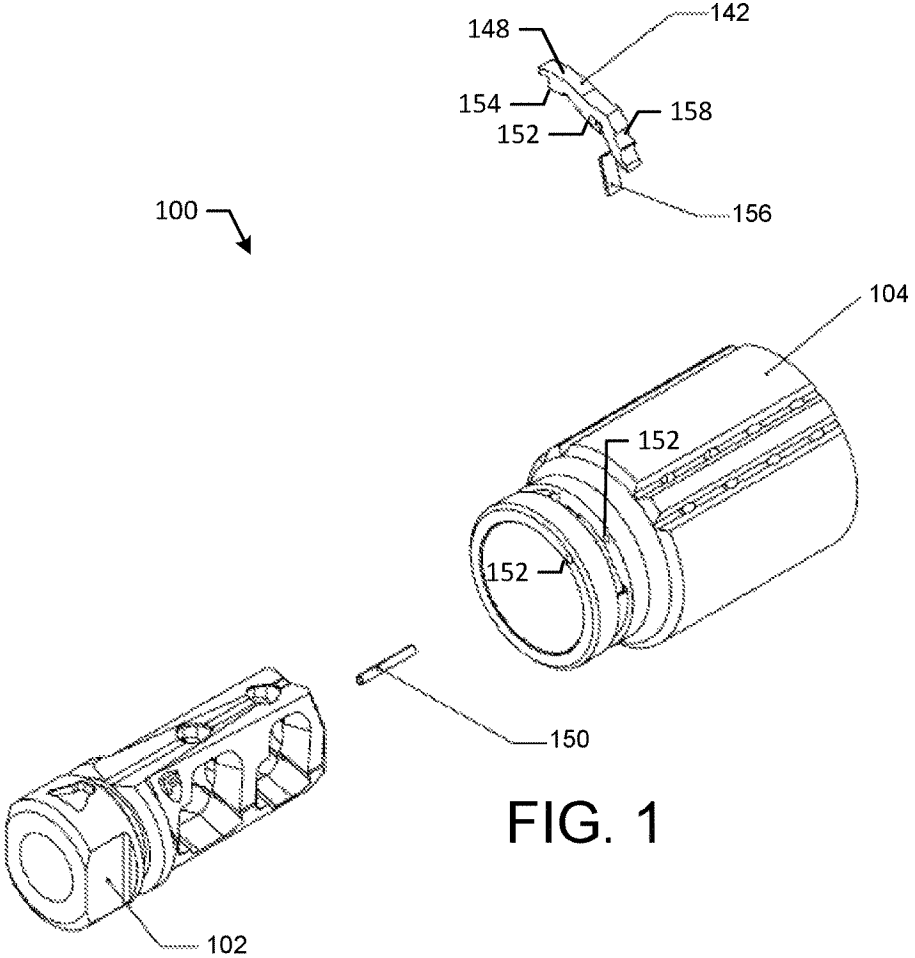
FIG. 1 depicts an exploded view of a blast control device in accordance with one or more embodiments of the disclosure.

Described below are embodiments of a blast control device (as well as individual components of the blast control device) that can be attached to a firearm. Methods of installing and using the blast control device on the firearm are also disclosed. The firearm may be a conventional firearm. For example, the firearm may be an M-16 style rifle, an AR-15 style rifle, an AR-10 style rifle, or an M-4 style rifle, among others. The firearm may be a handgun or shotgun. Any type of firearm may be used in conjunction with the blast control device. The blast control device may be configured to aid in the funneling of gases forward and/or out of the top of the blast control device to reduce and/or redirect the muzzle jump, muzzle recoil, muzzle blast, and/or muzzle flash generated by the firing of the firearm by directing, slowing, expanding, trapping, and/or cooling the propellant gases associated with the firing of the firearm.

The blast control device may include a muzzle brake and a blast shield. The blast shield may be attached around the muzzle brake. In some instances, the muzzle brake may include a first end, a second end, a top, a bottom, a bore, one or more baffles, one or more gas openings disposed between the one or more baffles, an alignment channel disposed on the top, one or more gas holes disposed on the top within the alignment channel, an alignment groove disposed at an end of the alignment channel, and a latch notch.

The blast shield may include an alignment protrusion, a latch assembly, a plurality of internal ribs, and one or more gas ports. In certain embodiments, the internal ribs may comprise circular ribs. The gas ports may be disposed on each side of the internal ribs. In this manner, the internal ribs may direct gases towards the gas ports. The latch assembly may be at least partially disposed within a slot in the blast shield. The latch assembly may include a pivoting latch attached to a pivot pin disposed in a pin hole that passes through the slot. The pivoting latch may include a catch on one end and a spring on an opposite end such that the pivoting latch is biased in a closed position.

The alignment channel may comprise an elongated axial channel, and the alignment groove may comprise a circular groove transverse to and in communication with the alignment channel. In this manner, the alignment protrusion may be slid along the alignment channel into the alignment groove. The alignment protrusion may be rotated within the alignment groove. The catch may be configured to mate with the latch notch to limit rotation of the alignment protrusion within the alignment groove and ensure proper positioning of the blast shield about the muzzle brake. In addition, a front and a rear wall of the alignment groove may limit axial movement of the alignment protrusion.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

FIGS. 1-5 depict a blast control device 100. The blast control device 100 may include a muzzle brake 102 and a blast shield 104. The blast shield 104 may be attached around the muzzle brake 102. For example, the muzzle brake 102 may be attached to the muzzle of a firearm, and the blast shield 104 may be positioned (e.g., slid at an angle) over the muzzle brake 102 and rotated to lock the blast shield 104 into place.

In certain embodiments, as depicted in FIGS. 6-10, the muzzle brake 102 may include a first end 106 (or rear end), a second end 108 (or front end), a top 110, a bottom 112, and a bore 114. In some instances, the first end 106 of the bore 114 may include internal threads 116 for attaching the muzzle brake 102 to the muzzle of a firearm. The muzzle brake 102 also may include one or more baffles 118, one or more gas openings 120 disposed between the baffles 118, and one or more gas holes 124. The baffles 118, the gas openings 120, and the gas holes 124 may be used to control the flow of gasses from firing the firearm. The muzzle brake 102 may be any size, shape, or configuration.

An alignment channel 122 may be disposed at the top 110 of the muzzle brake 102. The alignment channel 122 may be disposed at any location about the muzzle brake 102. The alignment channel 122 may extend axially along an outer surface of the muzzle brake 102. The alignment channel 122 may be any size, shape, or configuration. In some instances, the gas holes 124 may be disposed on the top 110 of the muzzle brake 102 within the alignment channel 122. The gas holes 124 may be disposed at any location about the muzzle brake 102. In addition, an alignment groove 126 may be disposed at an end of the alignment channel 122. In this manner, the alignment channel 122 and the alignment groove 126 may be in communication with each other. The alignment groove 126 may comprise a circular groove along an outer surface of the muzzle brake 102. The alignment groove 126 may be any size, shape, or configuration. In some instances, the alignment groove 126 may be substantially transverse to the alignment channel 122.

The muzzle brake 102 also may include a latch notch 128. The latch notch 128 may be disposed about the first end 106 of the muzzle brake 102 at the top 110 thereof. The latch notch 128 may be any size, shape, or configuration. The latch notch 128 may be located anywhere on the muzzle brake 102.

Figure 3:
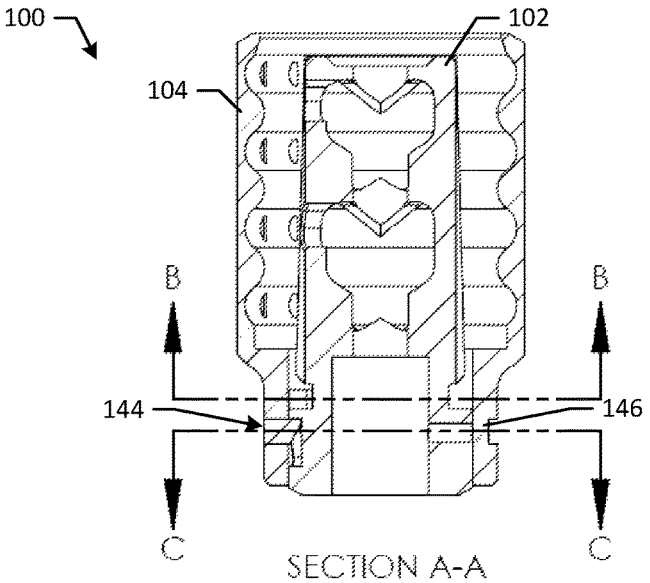
FIG. 3 depicts a cross-sectional view of a blast control device in accordance with one or more embodiments of the disclosure.
Figure 4:
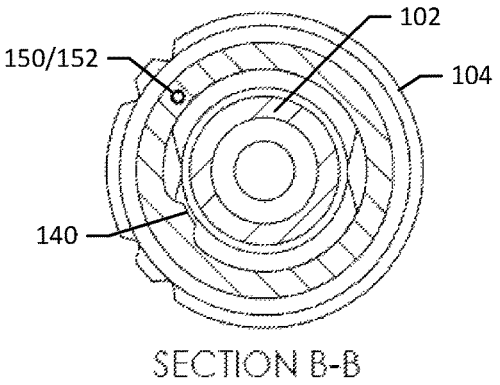
FIG. 4 depicts a cross-sectional view of a blast control device in accordance with one or more embodiments of the disclosure.
Figure 5:
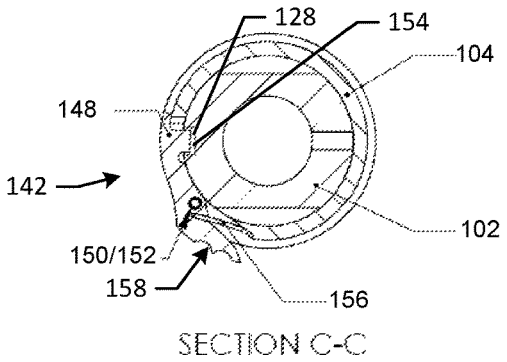
FIG. 5 depicts a cross-sectional view of a blast control device in accordance with one or more embodiments of the disclosure.
Figure 8:
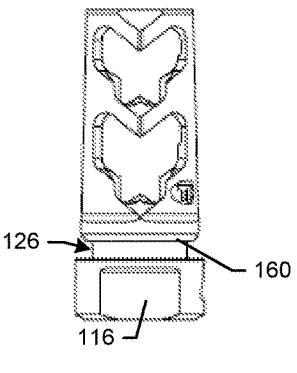
FIG. 8 depicts a side view of a muzzle brake in accordance with one or more embodiments of the disclosure.
Figure 7:
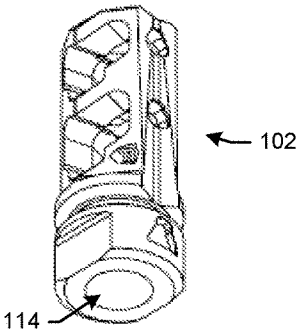
FIG. 7 depicts a perspective view of a muzzle brake in accordance with one or more embodiments of the disclosure.
Figure 6:
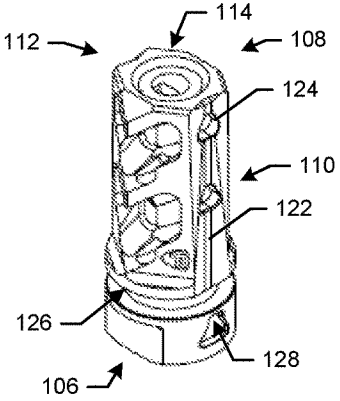
FIG. 6 depicts a perspective view of a muzzle brake in accordance with one or more embodiments of the disclosure.
Figure 10:
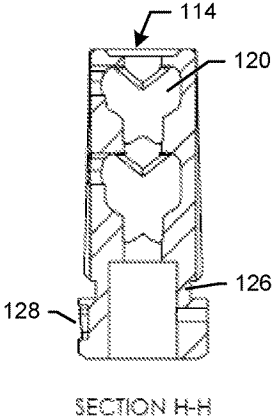
FIG. 10 depicts a cross-sectional view of a muzzle brake in accordance with one or more embodiments of the disclosure.
Figure 9:
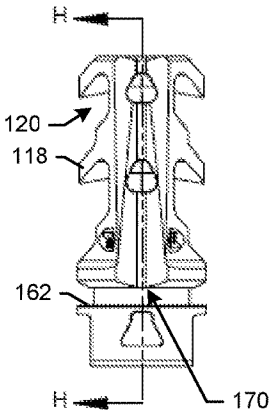
FIG. 9 depicts a side view of a muzzle brake in accordance with one or more embodiments of the disclosure.
Figure 13:
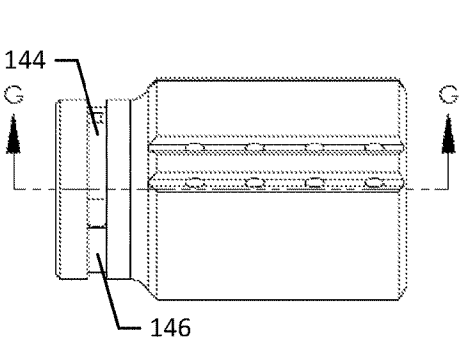
FIG. 13 depicts a side view of a blast shield in accordance with one or more embodiments of the disclosure.
Figure 15:
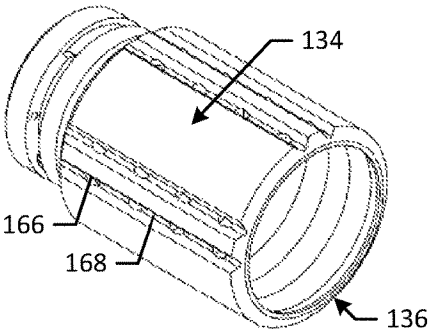
FIG. 15 depicts a perspective view of a blast shield in accordance with one or more embodiments of the disclosure.
Figure 16:
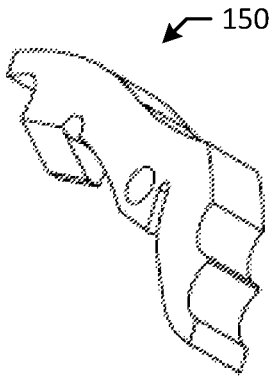
FIG. 16 depicts a perspective view of a portion of a latch assembly in accordance with one or more embodiments of the disclosure.
Figure 17:
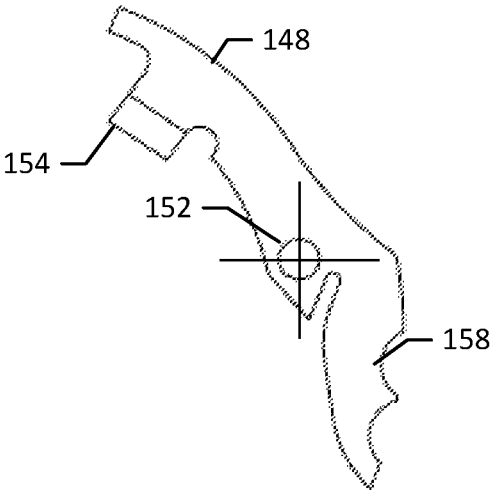
FIG. 17 depicts a side view of a portion of a latch assembly in accordance with one or more embodiments of the disclosure.

As depicted in FIGS. 11-15, the blast shield 104 may include a first end 130 (or rear end), a second end 132 (or front end), a top 134, a bottom 136, and a bore 138. As depicted in FIGS. 3-5, the blast shield 104 also may include an alignment protrusion 140 and a latch assembly 142. The latch assembly 142 may be at least partially disposed within a slot 144 in the blast shield 104. The slot 144 may extend from an outer surface of the blast shield to the bore 138. In some instances, the slot 144 may be disposed within a circular groove 146. The latch assembly 142 also may include a pivoting latch 148, as depicted in FIGS. 16 and 17, that is attached to a pivot pin 150 disposed in a pin hole 152 in the blast shield 104 and the pivoting latch 148. Referring back to FIGS. 1 and 3-5, the pin hole 152 may pass through the slot 144. The pivoting latch 148 may include a catch 154 on one end and a spring 156 (e.g., a leaf spring or the like) on an opposite end such that the pivoting latch 148 is biased in a closed position. In order to move the pivoting latch 148 from the closed position to an open position, a lever 158 of the pivoting latch 148 may be pressed to overcome the biasing force of the spring 156.

Figure 12:
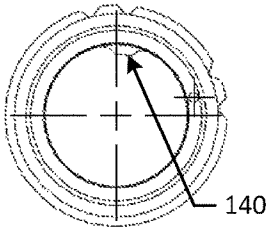
FIG. 12 depicts a front view of a blast shield in accordance with one or more embodiments of the disclosure.
Figure 11:
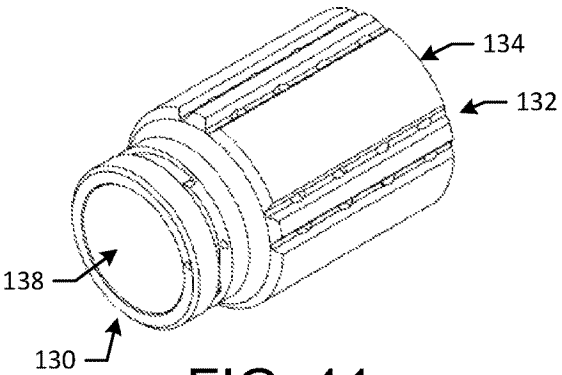
FIG. 11 depicts a perspective view of a blast shield in accordance with one or more embodiments of the disclosure.
Figure 14:
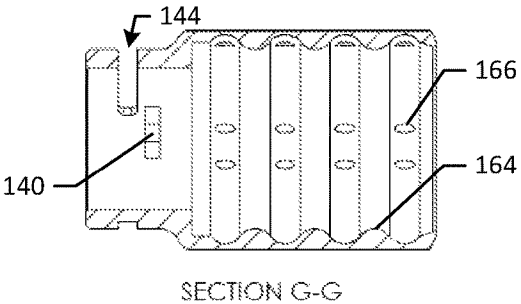
FIG. 14 depicts a cross-sectional view of a blast shield in accordance with one or more embodiments of the disclosure.

As depicted in FIGS. 12 and 14, the alignment protrusion 140 may be disposed within the bore 138 of the blast shield 104. In some instances, the alignment protrusion 140 may be offset from a top of the bore 138. The alignment protrusion 140 may be sized and shaped to nest within and slide along the alignment channel 122 and the alignment groove 126. In this manner, to attach the blast shield 104 to the muzzle brake 102, the alignment protrusion 140 may be slid along the alignment channel 122 and into the alignment groove 126. The alignment protrusion 140 may then be rotated within the alignment groove 126 until the catch 154 is inserted into the latch notch 128. That is, the catch 154 may be configured to mate with the latch notch 128 to limit rotation of the alignment protrusion 140 within the alignment groove 126 and ensure proper positioning of the blast shield 104 about the muzzle brake 102. In addition, a front wall 160 and a rear wall 162 of the alignment groove 126 may limit axial movement of the alignment protrusion 140 within the alignment groove 126.

In order to remove the blast shield 104 from around the muzzle brake 102, the lever 148 may be pressed to overcome the biasing force of the spring 156, which may pivot the pivoting latch 148 and release the catch 154 from the latch notch 128. The alignment protrusion 140 may then be rotated within the alignment groove 126 to align the alignment protrusion 140 with the alignment channel 122. The front wall 160 may include an opening 170 at the intersection between the alignment channel 122 and the alignment groove 126, which may enable the alignment protrusion 140 to pass between the alignment channel 122 and the alignment groove 126. Next, the alignment protrusion 140 may be slid along the alignment channel 122 to remove the blast shield 140 from the muzzle break 102. In some instances, an outer surface of the blast shield 104 may include a mark (such as a slit, groove, sticker, etc.) aligned with alignment protrusion 140 to help facilitate alignment of the alignment protrusions 140 with the alignment channel 122.

Referring back to FIG. 14, in certain embodiments, the blast shield 104 may include a plurality of internal ribs 164 and one or more gas ports 166. In certain embodiments, the internal ribs 164 may comprise circular ribs. The gas ports 166 may be disposed on each side of the internal ribs 164. In this manner, the internal ribs 164 may direct gases towards the gas ports 166. The internal ribs 164 may be equally spaced apart from one another or the spacing may be varied. In some instances, the internal ribs 164 may be radially spaced apart from an outer surface of the muzzle brake 102. The blast shield 104 may direct the gasses exiting the muzzle brake 102 forward and out of the front of the blast shield 104 and/or up and out of the top of the blast shield by way of the internal ribs 164 and the gas ports 166. In some instances, the gas ports 166 may be disposed about the top 134 of the blast shield 104. In other instances, the gas ports 166 may be offset from the top 134 of the blast shield 104. For example, the gas ports 166 may be disposed within axial channels 168 disposed on an outer surface of the blast shield 104.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can", "could", "might", or "may", unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A blast control device for a firearm, comprising:

a muzzle brake with a bore end and an opposing second end, the muzzle brake comprising an alignment channel, an alignment groove disposed at an end of the alignment channel, and a latch notch, wherein the alignment channel extends axially along an outer surface of the muzzle brake from the opposing second end to the alignment groove; and a blast shield configured to be coupled to the muzzle brake via a latch assembly, wherein the blast shield comprises an alignment protrusion, the latch assembly, and one or more gas ports.

2. The device of claim 1, wherein the latch assembly is at least partially disposed within a slot in the blast shield.

3. The device of claim 2, wherein the latch assembly comprises a pivoting latch attached to a pivot pin disposed in a pin hole, wherein the pivoting latch comprises a catch on one end and a spring on an opposite end such that the pivoting latch is biased in a closed position.

4. The device of claim 3, wherein the alignment protrusion is slidable along the alignment channel into the alignment groove.

5. The device of claim 4, wherein the alignment protrusion is rotatable within the alignment groove.

6. The device of claim 5, wherein the catch is configured to mate with the latch notch to limit rotation of the alignment protrusion within the alignment groove and ensure proper positioning of the blast shield about the muzzle brake.

7. The device of claim 6, wherein a front and a rear wall of the alignment groove limit axial movement of the alignment protrusion.

* * * * *